US008524043B2

(12) United States Patent
Ding

(10) Patent No.: US 8,524,043 B2
(45) **Date of Patent: *Sep. 3, 2013**

(54) SYSTEM FOR PRODUCING HIGH QUALITY GASOLINE BY CATALYTIC HYDROCARBON RECOMBINATION

(76) Inventor: Ranfeng Ding, Beijing (CN)

( * ) Notice: Subject to any disclaimer, the term of this patent is extended or adjusted under 35 U.S.C. 154(b) by 606 days.

This patent is subject to a terminal disclaimer.

(21) Appl. No.: 12/682,034

(22) PCT Filed: Nov. 5, 2008

(86) PCT No.: PCT/CN2008/072943

§ 371 (c)(1),
(2), (4) Date: Apr. 7, 2010

(87) PCT Pub. No.: WO2009/067885

PCT Pub. Date: Jun. 4, 2009

(65) Prior Publication Data

US 2010/0243522 A1 Sep. 30, 2010

(30) Foreign Application Priority Data

Nov. 9, 2007 (CN) ..... 2007 1 0169942
Nov. 9, 2007 (CN) ..... 2007 1 0169947
Nov. 9, 2007 (CN) ..... 2007 1 0169949

(51) Int. Cl.
*B01J 8/00* (2006.01)
*B01D 11/00* (2006.01)

(52) U.S. Cl.
USPC ..... 196/14.52; 196/105; 422/608

(58) Field of Classification Search
USPC ..... 196/14.52, 105; 422/608; 208/95, 208/308, 313
See application file for complete search history.

(56) References Cited

U.S. PATENT DOCUMENTS 5,021,143 A * 6/1991 Franckowiak et al. ..... 208/70
5,132,486 A * 7/1992 Wylie ..... 585/826
5,360,532 A * 11/1994 Fletcher et al. ..... 208/89
7,799,210 B2 * 9/2010 Dysard et al. ..... 208/212
7,867,383 B2 * 1/2011 Ding ..... 208/313

FOREIGN PATENT DOCUMENTS

CN 201154953 11/2008

OTHER PUBLICATIONS

International Search Report of International Application No. PCT/CN2008/072943, dated Feb. 19, 2009.

* cited by examiner

*Primary Examiner* — Nina Bhat
(74) *Attorney, Agent, or Firm* — J.C. Patents

(57) ABSTRACT

This invention relates to a system for the preparation of a high quality gasoline through the recombination of catalytic hydrocarbon and its process. The characteristics are as follows: the upper part of the fractionator is connected with light petrol hydrogenation unit through the light petrol pipeline. The lower part of the fractionator is connected with the extractor through the heavy petrol pipeline. The upper part of the extractor directly extracts the product through the pipeline and the lower part of the extractor is connected to the light petrol pipeline behind the light petrol hydrogenation unit. Compared with the prior art, this invention has the following advantages: the volume of used catalyst is greatly reduced. In addition, the sulfur reduction and olefin reduction effect are remarkable by using the hydrogenation units with special catalysts and parameters regarding different petrol fractions.

5 Claims, 3 Drawing Sheets

SYSTEM FOR PRODUCING HIGH QUALITY GASOLINE BY CATALYTIC HYDROCARBON RECOMBINATION

FIELD OF THE INVENTION

This invention relates to a system for the preparation of a high quality gasoline and its process, and more particularly to a system for the preparation of a high quality gasoline through the recombination of catalytic hydrocarbon and its process.

BACKGROUND OF THE INVENTION

Catalytic cracking, catalytic schizolysis and heavy oil catalytic schizolysis technology is the key technology of the oil refining, catalytic schizolysis is classified into the catalytic schizolysis of wax oil and the catalytic schizolysis of heavy oil. The generated oils produced from these processes are collectively called catalytic hydrocarbons. Through the processing & handling, generally fractionation with fractionation fractionator, the obtained catalytic hydrocarbons can be fractionated into the products such as dry petroleum gas, liquefied petroleum gas, gasoline, diesel oil and heavy oil etc. Among them, the gasoline and diesel oil occupy above 70% of the supply volume of the gasoline and diesel oil in the market.

As the environmental protection requirements become more and more strict, the standard of gasoline & diesel oil will be increased continuously. The current processing method wherein the catalytic hydrocarbons go through the fractionator has the following shortcomings: the first is that the quality of the produced gasoline and diesel oil should be improved, the alkene content is too high, octane value (RON) is too low, the cetane number of the diesel oil is too low, the stability does not conform to the requirements. The second is that the above processing method can not produce multiple grades of gasoline simultaneously, in addition, there is only one product type. The third is that the proportion between produced gasoline and diesel oil does not conform to the market need, the diesel oil can not satisfy the need, whereas the gasoline is in oversupply status.

In order to solve the above problem, Chinese patent with patent No. 03148181.7 namely "treatment method of catalyzing the hydrocarbon recombination" has provided a type of treatment method of catalyzing the hydrocarbon recombination, furthermore, the Chinese patents with patent No. 200310103541.9 and 200310103540.4 have given publicity to the improved patents concerning the water rinsing system and solvent recycling, however, the methods of reducing sulfur and olefin have not been touched upon in these publicized patents.

The current GB17930 gasoline standard requires that the sulfur content is below 0.05% (wt), the olefin content is below 35% (v) and the benzene content is below 2.5% (v). Most of the refineries can assure the quality of the gasoline. However, the National Gasoline Standard III that will be implemented in 2010 requires the following: the sulfur content is below 0.015% (wt), the olefin content is below 25% (v) or even lower and the benzene content is below 1% (v). For most of the refineries, they must be confronted with the requirements of higher standard, i.e., the National Gasoline Standard IV: the sulfur content is below 0.005% (wt), the olefin content is below 25% (v) or even lower. Gasoline quality solution must consider the transition from National Gasoline Standard III to National Gasoline Standard IV. The better planning is to follow National Gasoline Standard IV in single step.

Since the proportions of blended components in the gasoline products of our country differ greatly with those of the developed countries, the catalytic cracking gasoline (hereafter called catalytic gasoline) occupies a high proportion while reformed gasoline and gasoline alkyl ate only occupies a little proportion. Furthermore, this condition will exist for a long time. Therefore, the method of reducing sulfur and olefin mainly touches upon the problem of catalyzed gasoline.

It is generally acknowledged that 5-10% of the general sulfur in the catalytic cracking material will enter the gasoline fraction. According to the characteristics of the refineries in our country that catalytic material hydrogenation purification capability is low, secondary processing catalytic cracking capability is high and there is residual oil coking, the sulfur content of the catalytic gasoline in the refinery processing the crude oil with low sulfur content (sulfur content 0.3%) is about 200 ppm, if the crude oil with sulfur content of 0.8%, the sulfur content of the catalytic gasoline is about 900 ppm. Therefore, the difficult point in the upgrade of gasoline quality has changed from the problem of olefin to the problem of sulfur. It is impossible to radically solve the problem of sulfur through the improvement of catalytic cracking process or catalyst. The catalytic cracking material hydrogenation and desulfurization cannot be applied in large scale due to big investment, high operation cost and current condition in the refineries. Furthermore, it is inapplicable to the refineries processing rude oil with low sulfur content. In the meantime, the catalytic cracking equipment excessively reduces the olefin; therefore, it will aggravate the loss of benzoline and the octane number (RON) of the gasoline.

Therefore, it is a technical problem that how to provide a system for blended gasoline having low sulfur content, low olefin content and high octane number (RON) with low cost.

SUMMARY OF THE INVENTION

One of the object of the invention is to provide a gasoline catalytic hydrocarbon recombination system having low sulfur content, low olefin content and high octane number (RON) with low cost is provided.

In order to realize the above purpose, this invention adopts the following technical resolution: A system for the preparation of a high quality gasoline through the recombination of catalytic hydrocarbon, including fractionator, wherein the upper part of the said fractionator is connected with light petrol hydrogenation equipment through the light petrol pipeline. The lower part of the said fractionator is connected with the extractor through the heavy petrol pipeline. The upper part of the said extractor directly extracts the product through the pipeline and the lower part of the said extractor is connected to the light petrol pipeline behind the light petrol hydrogenation unit.

A preferred system, wherein the lower part of the said fractionator is connected with the heavy petrol hydrogenation unit through heavy petrol pipeline, the said heavy petrol hydrogenation unit is then connected to the extractor through the pipeline.

A preferred system, wherein the lower part of the said extractor is connected with the aromatic hydrocarbon hydrogenation unit through the pipeline, the said aromatic hydrocarbon hydrogenation unit is then connected to the light petrol hydrogenation unit through the pipeline.

Another object of the invention is to provide the process of said high quality gasoline preparation through catalytic hydrocarbon recombination.

The technical resolution as follows:

A process for the preparation of a high quality gasoline through catalytic hydrocarbon recombination, wherein the stabilized gasoline is put into the fractionator to carry out the distilling and fractionize into the light petrol and heavy petrol. The above light petrol enters the light petrol hydrogenation unit to carry out the hydrogenation. The above heavy petrol is extracted in the extractor and separate into aromatic hydrocarbon and raffinate oil. The above aromatic hydrocarbon is blended with the light petrol after the hydrogenation treatment through the pipeline and the above raffinate oil will be directly extracted as chemical light oil.

A preferred process, wherein hydration treatment is first carried out in the heavy petrol hydration unit to the said heavy petrol before the extraction is carried out in the extractor.

A preferred process, wherein first hydration treatment is carried out to the above aromatic hydrocarbon, then it is blended with and used together with the light petrol after the hydration treatment through the pipeline.

A preferred process, wherein the fractionator overhead temperature of the above fractionator is 100~110° C., the fractionator bottom temperature is 206~226° C., the fractionator overhead pressure of the above fractionator is 0.11~0.28 MPa (absolute pressure), the fractionator bottom pressure is 0.12~0.30 MPa (absolute pressure), the distillation range of the above light petrol is controlled to 30° C.~100° C. and the distillation range of the above heavy gasoline is controlled to 100° C.~205° C.

A preferred process, wherein the fractionator overhead temperature of the above fractionator is 105° C., the fractionator bottom temperature is 216° C., the fractionator overhead pressure of the above fractionator is 0.11~0.28 MPa (absolute pressure), the fractionator bottom pressure is 0.12~0.30 MPa (absolute pressure), the distillation range of the above light petrol is controlled to 30° C.~100° C. and the distillation range of the above heavy gasoline is controlled to 100° C.~205° C.

A preferred process, wherein the catalyst of the above light petrol hydrogenation unit is selective hydrogenation catalyst GHT-20, the volume airspeed ratio of the above light petrol hydrogenation unit is 2-4, hydrogen/oil volume ratio is 250~350, the operation temperature is 240~260° C., the operation pressure is 1.4~1.6 MPa (absolute pressure).

A preferred process, wherein the physical and chemical characteristics of the catalyst of the said light petrol hydrogenation unit, i.e., selective hydrogenation catalyst GHT-20 are as shown in the following table:

| Name of the index | Unit | GHT-20 |
|---|---|---|
| Appearance | | Grey three-leaf type |
| Specification | mm | Φ1.5-2.0 |
| Intensity | N/cm | 170 |
| Bulk density | g/ml | 0.70 |
| Specific surface | $m^2/g$ | 180 |
| Pore volume | ml/g | 0.5-0.6 |
| $WO_3$ | m % | 6.6 |
| NiO | m % | 2.1 |
| $C_0O$ | m % | 0.16 |

A preferred process, wherein the catalyst of the said heavy gasoline hydrogenation unit is full hydrogenation catalyst, GHT-22, the volume airspeed ratio of the said heavy gasoline hydrogenation unit is 2-4, hydrogen/oil volume ratio is 250~350, the operation temperature is 290~330° C., the operation pressure is 1.2~3 MPa (absolute pressure).

A preferred process, wherein the physical and chemical characteristics of the said heavy gasoline hydrogenation unit GHT-22 are as shown in the following table:

| Name of the index | Unit | GHT-22 |
|---|---|---|
| Appearance | | Grey three-leaf type |
| Specification | mm | Φ1.5-2.0 |
| Intensity | N/cm | 180 |
| Bulk density | g/ml | 0.73 |
| Specific surface | $m^2/g$ | 180 |
| Pore volume | ml/g | 0.5-0.6 |
| $WO_3$ | m % | 15 |
| NiO | m % | 1.7 |
| $C_0O$ | m % | 0.15 |
| $Na_2O$ | m % | <0.09 |
| $Fe_2O_3$ | m % | <0.06 |
| $SiO_2$ | m % | <0.60 |
| Carrier | m % | 82.4 |

A preferred process, wherein the catalyst of the above aromatic hydrocarbon hydrogenation unit is full hydrogenation catalyst, GHT-22, the volume airspeed ratio of the said aromatic hydrocarbon hydrogenation unit is 2-3, hydrogen/oil volume ratio is 250~300, the operation temperature is 285~325° C., the operation pressure is 1.5~2.5 MPa (absolute pressure).

A preferred process, wherein the physical and chemical characteristics of the catalyst of the said aromatic hydrocarbon hydrogenation unit, i.e., full hydrogenation catalyst GHT-22 are as shown in the following table:

| Name of the index | Unit | GHT-22 |
|---|---|---|
| Appearance | | Grey three-leaf type |
| Specification | mm | Φ1.5-2.0 |
| Intensity | N/cm | 180 |
| Bulk density | g/ml | 0.73 |
| Specific surface | $m^2/g$ | 180 |
| Pore volume | ml/g | 0.5-0.6 |
| $WO_3$ | m % | 15 |
| NiO | m % | 1.7 |
| $C_0O$ | m % | 0.15 |
| $Na_2O$ | m % | <0.09 |
| $Fe_2O_3$ | m % | <0.06 |
| $SiO_2$ | m % | <0.60 |
| Carrier | m % | 82.4 |

The fractionator used in this invention is the fractionator disclosed in the China patent 03148181.7 namely "catalytic hydrocarbon recombination treatment method". The said extractor uses the extractor disclosed in the China patents 200310103541.9 and 200310103540.4, including solvent recycling and water rinsing system.

The hydrogenation unit used in this invention is the current hydrogenation unit, including heating furnace, heat exchanger, high-pressure separator, air condenser and water condenser etc.

BRIEF DESCRIPTION OF THE DRAWING

In the following, we will further explain this invention through attached drawings and embodiments, but this does not mean the limitation to this invention.

DETAILED DESCRIPTION OF THE PREFERRED EMBODIMENT

Embodiment 1

Figure 1:
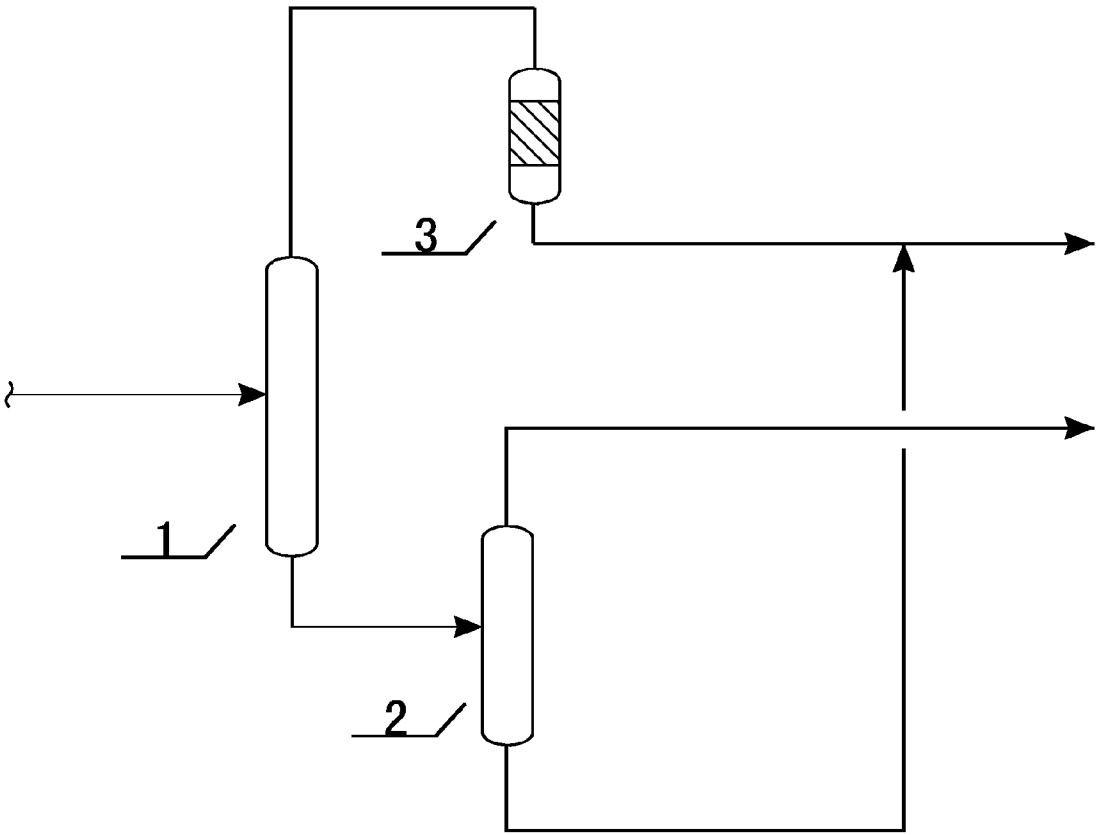
FIG. 1 is the schematic flow sheet of embodiment 1.

See FIG. 1, it is the schematic flow sheet of this embodiment. The gasoline is fractionated at fractionator 1 with the flow rate of 100,000 ton/year to the stabilized gasoline (catalytic gasoline) wherein the distilling range is 30-205° C., sulfur content is 85 ppm, mercaptan content is 15 ppm, olefin content is 25% (v), diolefin content is 0.1% (v), aromatic hydrocarbon content is 13% (v), octane number (RON) is 87, density is 728 kg/m$^3$, the overhead temperature of the fractionator 1 is 105° C., the fractionator bottom temperature is 216° C., fractionator overhead pressure is 0.2 MPa (absolute pressure), fractionator bottom pressure is 0.25 MPa (absolute pressure), light petrol and heavy petrol can be separately obtained. The above light petrol (distilling range 30-100° C.) is vaporized through the overhead of fractionator 1, the total vaporization volume is 50,000 tons/year, then it enters the light petrol hydrogenation apparatus 3 to carry out hydrogenation treatment. The catalyst of the above light petrol hydrogenation apparatus 3 is selective hydrogenation catalyst GHT-20, The volume airspeed ratio of the above light petrol hydrogenation unit 3 is 4, hydrogen/oil volume ratio is 300, the operation temperature is 250° C., the operation pressure is 1.5 MPa (absolute pressure) (selective hydrogenation). The above heavy petrol (distilling range is 100-205° C.) enters the heavy petrol extractor 2 for solvent extraction with the flow rate of 50000 tons/year and aromatic hydrocarbon and raffinate oil are separated out. The solvent used in the above extractor 2 is sulfolane, the extraction temperature is 120° C., the ratio of solvent (solvent/feed material) is 4.0, the rinsing ratio of the raffinate oil is 0.2 (mass), the recovered temperature of the solvent is 175° C., the recovered pressure of the solvent is 0.065 MPa (absolute pressure), the above aromatic hydrocarbon is blended with the hydrogenated light petrol with the flow rate of 11000 tons/year, the above raffinate oil is extracted out as the chemical light petrol with the flow rate of 39000 tons/year.

The distilling range of the obtained blended petrol is 30-205° C., the sulfur content is 102.8 ppm, the mercaptan content is 4.3 ppm, the olefin content is 17.9% (v), the diolefin content is 0.05% (v), the aromatic hydrocarbon content is 20.0% (v), the octane number (RON) is 91.8, the density is 700.6 kg/m$^3$, the oil produced is 39000 tons/year.

The distilling range of the obtained chemical light petrol is 100-205° C., the sulfur content is 29.0 ppm, the mercaptan content is 1.0 ppm, the olefin content is 28.2% (v), the diolefin content is 0.01% (v), the aromatic hydrocarbon content is 3.0% (v), the octane number (RON) is 78.5, the density is 775.5 kg/m$^3$, the oil produced is 39,000 tons/year.

The physical and chemical characteristics of the selective hydrogenation catalyst GHT-20 are as shown in the following table:

| Name of the index | Unit | GHT-20 |
|---|---|---|
| Appearance | | Grey three-leaf type |
| Specification | mm | Φ1.7 |
| Intensity | N/cm | 170 |
| Bulk density | G/ml | 0.70 |
| Specific surface | M$^2$/g | 180 |
| Pore volume | ml/g | 0.55 |
| $WO_3$ | M % | 6.6 |

-continued

| Name of the index | Unit | GHT-20 |
|---|---|---|
| NiO | M % | 2.1 |
| $C_0O$ | M % | 0.16 |

The measuring methods used in this invention are as follows:

1. Distilling range: GB/T6536-1997 petroleum products—determination of distillation
2. Sulfur content: SH/T0689-2000 light hydrocarbon & engine fuel and other petroleum products-determination of total sulfur content (ultra-luminescence method)
3. Mercaptan sulfur: GB/T1792-1988 Distillate fuels—Determination of mercaptan sulphur—Potentiometric titration method
4. Olefin: GB/T11132-2002 Liquid petroleum products-Determination of hydrocarbon types-Fluorescent indicator absorption method
5. Aromatic hydrocarbon: GB/T11132-2002 Liquid petroleum products-Determination of hydrocarbon types-Fluorescent indicator absorption method
6. Octane number: GB/T5487 gasoline-testing methods for octane number-research method
7. Density: GB/T1884-2000, method for laboratory measurement of crude oil and liquid petroleum products (densitometer method)
8. Measurement of the diolefin: titration method
9. Hydrogenation catalyst analysis method:

| Chemical component | Analytical procedure | Applied petrochemical industry standard |
|---|---|---|
| NiO | Colorimetric analysis | SH/T0346-1992 |
| CoO | Colorimetric analysis | SH/T0345-1992 |
| $WO_3$ | Colorimetric analysis | |
| Physical characteristics | Analytical procedure | Applied instrument |
| Surface area | Low temperature nitrogen adsorption | 2400 model sorption analyzer |
| Pore volume | Mercury intrusion method | Auto Pore II 9200 |
| Intensity | Cold Crushing Strength measurement method | DL II type intelligent granular intensity measuring gauge |
| Bulk density | Weighing method | |

Embodiment 2

Figure 2:
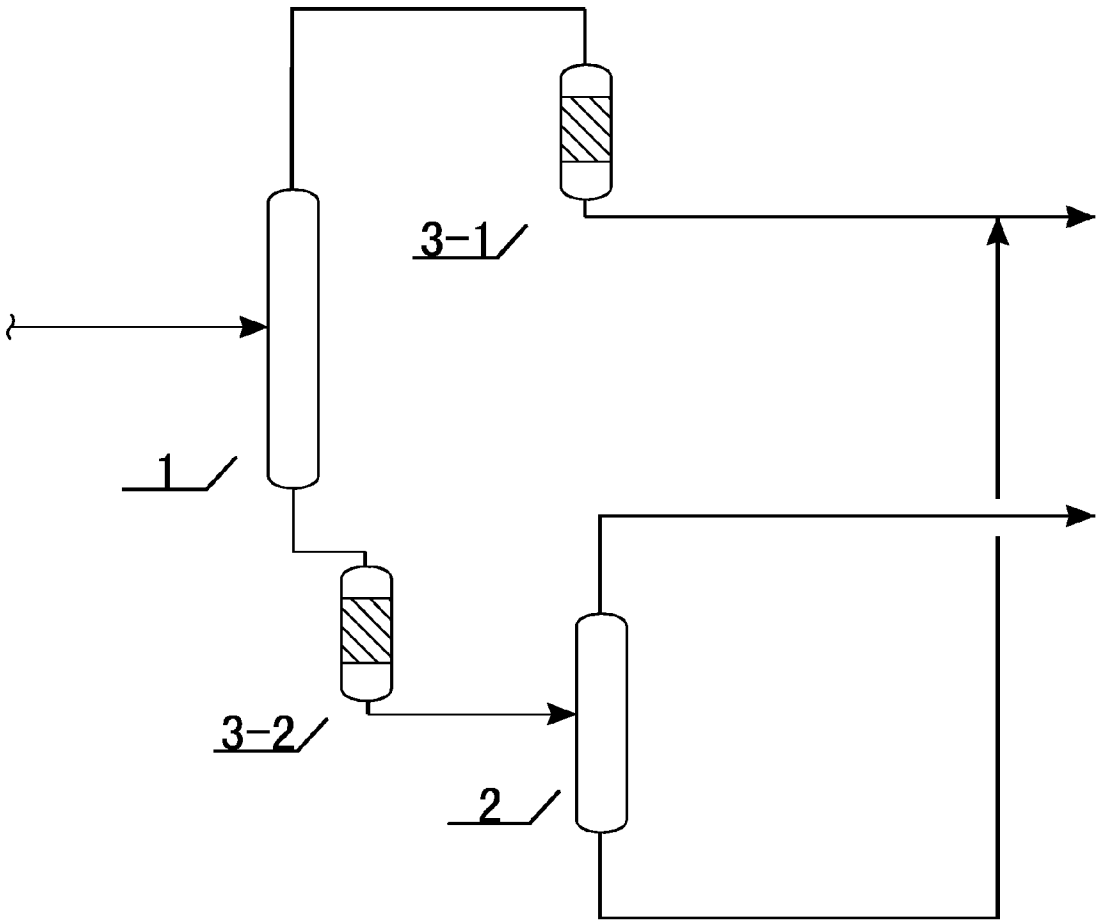
FIG. 2 is the schematic flow sheet of embodiment 2 and 3.

See FIG. 2, it is the schematic flow sheet of this embodiment. The gasoline is fractionated at fractionator 1 with the flow rate of 100,000 ton/year in the fractionator 1 to the stabilized gasoline (catalytic gasoline) wherein low sulfur content whose distilling range is 30-205° C., the sulfur content is 100 ppm, the mercaptan content is 5 ppm, the olefin content is 30% (v), the diolefin content is 0.1% (v), the aromatic hydrocarbon content is 15% (v), the octane number (RON) is 89, density is 728 kg/m$^3$, the fractionator overhead temperature of fractionator 1 is 82° C., the fractionator bottom temperature is 186° C., fractionator overhead pressure is 0.2 MPa (absolute pressure), fractionator bottom pressure is 0.25 MPa (absolute pressure), light petrol and heavy petrol can be separately obtained. The above light petrol (distilling range 30-80° C.) is vaporized through the upper of fractionator 1, the total vaporization volume is 40,000 tons/year, then it enters the light petrol hydrogenation apparatus 3-1 to carry out hydrogenation treatment. The catalyst of the above light petrol hydrogenation apparatus 3-1 is selective hydrogenation catalyst GHT-20, The volume airspeed ratio of the above light petrol hydrogenation unit 3-1 is 2, hydrogen/oil volume ratio is 150, the operation temperature is 220° C., the operation pressure is 0.6 MPa (absolute pressure). The above heavy petrol (distilling range is 80-205° C.) enters the heavy petrol hydrogenation unit 3-2 to carry out hydrogenation treatment with the flow rate of 60000 tons/year, the catalyst of the above heavy petrol hydrogenation apparatus 3-2 is full hydrogenation catalyst GHT-22. The volume airspeed ratio of the above heavy petrol hydrogenation unit 3-2 is 2, hydrogen/oil volume ratio is 250, the operation temperature is 290° C., the operation pressure is 1.2 MPa (absolute pressure). Then it passes through the pipeline into the heavy petrol extractor 2 to carry out the extraction separation and the aromatic hydrocarbon & raffinate oil can be separated. The solvent used in extractor 2 is N-pyrrolidone, the extraction temperature is 115° C., the solvent ratio (solvent/feed material) is 3.5 (mass), the rinsing ratio of the raffinate oil is 0.2 (mass), the solvent recovered temperature is 151° C., the recovery pressure of the solvent is 0.112 MPa (absolute pressure). The above aromatic hydrocarbon is blended with the above-hydrogenated light petrol with the flow rate of 15000 tons/year, the above raffinate oil is extracted out with the flow rate of 45000 tons/year as the fine quality ethylene material. The distilling range of the obtained blended gasoline is 30-205° C., the sulfur content is 5.27 ppm, the mercaptan content is lower than 1 ppm, olefin content is 17.8% (v), the diolefin content is 0.01% (v), the aromatic hydrocarbon content is 25.6% (v), the octane number (RON) is 94.1, the density is 703.8 kg/m$^3$, the extraction volume is 55000 tons/year.

The distilling range of the obtained fine quality ethylene material is 80-205° C., the sulfur content is 2.0 ppm, the mercaptan content is lower than 1 ppm, olefin content is 0.1% (v), the diolefin content is 0.01% (v), the aromatic hydrocarbon content is 3.0% (v), the octane number (RON) is 81.0, the density is 760.0 kg/m$^3$, the extraction volume is 45000 tons/year. The physical and chemical characteristics of the selective hydrogenation catalyst GHT-20 are as shown in the following table:

| Name of the index | Unit | GHT-20 |
|---|---|---|
| Appearance | | Grey three-leaf type |
| Specification | mm | Φ1.7 |
| Intensity | N/cm | 170 |
| Bulk density | g/ml | 0.70 |
| Specific surface | m$^2$/g | 180 |
| Pore volume | ml/g | 0.55 |
| $WO_3$ | m % | 6.6 |
| NiO | m % | 2.1 |
| $C_0O$ | m % | 0.16 |

The physical and chemical characteristics of the full hydrogenation catalyst GHT-22 are as shown in the following table:

| Name of the index | Unit | GHT-22 |
|---|---|---|
| Appearance | | Grey three-leaf type |
| Specification | mm | Φ1.7 |
| Intensity | N/cm | 180 |
| Bulk density | g/ml | 0.73 |
| Specific surface | m$^2$/g | 180 |
| Pore volume | ml/g | 0.57 |
| $WO_3$ | m % | 15 |
| NiO | m % | 1.7 |

-continued

| Name of the index | Unit | GHT-22 |
|---|---|---|
| $C_0O$ | m % | 0.15 |
| $Na_2O$ | m % | <0.09 |
| $Fe_2O_3$ | m % | <0.06 |
| $SiO_2$ | m % | <0.60 |
| Carrier | m % | 82.4 |

The measuring methods used in this invention are as follows (same below):

1. Distilling range: GB/T6536-1997 petroleum products—determination of distillation
2. Sulfur content: SH/T0689-2000 light hydrocarbon & engine fuel and other petroleum products-determination of total sulfur content (ultra-luminescence method)
3. Mercaptan sulfur: GB/T1792-1988 Distillate fuels—Determination of mercaptan sulphur—Potentiometric titration method
4. Olefin: GB/T11132-2002 Liquid petroleum products-Determination of hydrocarbon types-Fluorescent indicator absorption method
5. Aromatic hydrocarbon: GB/T11132-2002 Liquid petroleum products-Determination of hydrocarbon types-Fluorescent indicator absorption method
6. Octane number: GB/T5487 gasoline-testing methods for octane number-research method
7. Density: GB/T1884-2000, method for laboratory measurement of crude oil and liquid petroleum products (densitometer method)
8. Measurement of the diolefin: titration method
9. Hydrogenation catalyst analysis method:

| Chemical component | Analytical procedure | Applied petrochemical industry standard |
|---|---|---|
| NiO | Colorimetric analysis | SH/T0346-1992 |
| CoO | Colorimetric analysis | SH/T0345-1992 |
| $WO_3$ | Colorimetric analysis | |
| Physical characteristics | Analytical procedure | Applied instrument |
| Surface area | Low temperature nitrogen adsorption | 2400 model sorption analyzer |
| Pore volume | Mercury intrusion method | Auto Pore II 9200 |
| Intensity | Cold Crushing Strength measurement method | DL II type intelligent granular intensity measuring gauge |
| Bulk density | Weighing method | |

Embodiment 3

As shown in FIG. 2, it is the schematic flow sheet of this embodiment.

The gasoline is fractionated at fractionator 1 with the flow rate of 100,000 ton/year to the stabilized gasoline (catalytic gasoline) with high sulfur content whose distilling range is 30-205° C., the sulfur content is 2000 ppm, the mercaptan content is 50 ppm, the olefin content is 40% (v), the diolefin content is 1.0% (v), the aromatic hydrocarbon content is 19% (v), the octane number (RON) is 91, density is 728 kg/m$^3$, the fractionator overhead temperature of fractionator 1 is 86° C., the fractionator bottom temperature is 192° C., fractionator overhead pressure is 0.2 MPa (absolute pressure), fractionator bottom pressure is 0.25 MPa (absolute pressure), light petrol and heavy petrol can be separately obtained. The above light petrol (distilling range 30-80° C.) is vaporized through the upper of fractionator 1, the total vaporization volume is 43,000 tons/year, then it enters the light petrol hydrogenation apparatus 3-1 to carry out hydrogenation treatment. The catalyst of the above light petrol hydrogenation apparatus 3-1 is selective hydrogenation catalyst GHT-20, The volume airspeed ratio of the above light petrol hydrogenation unit 3-1 is 4, hydrogen/oil volume ratio is 300, the operation temperature is 280° C., the operation pressure is 2.0 MPa (absolute pressure). The above heavy petrol (distilling range 90-205° C.) enters heavy petrol hydrogenation unit 3-2 to carry out hydrogenation treatment with the flow rate of 57000 tons/year. The catalyst of the light petrol hydrogenation apparatus 3-2 is selective hydrogenation catalyst GHT-20, the volume airspeed ratio of the above light petrol hydrogenation unit 3-2 is 4, hydrogen/oil volume ratio is 350, the operation temperature is 330° C., the operation pressure is 3.0 MPa (absolute pressure). Then it passes through the pipeline into the heavy petrol extractor 2 to carry out the extraction separation and the aromatic hydrocarbon & raffinate oil can be separated. The solvent used in extractor 2 is N-pyrrolidone, the extraction temperature is 115° C., the solvent ratio (solvent/feed material) is 3.5 (mass), the rinsing ratio of the raffinate oil is 0.2 (mass), the solvent recovered temperature is 151° C., the recovery pressure of the solvent is 0.112 MPa (absolute pressure). The above aromatic hydrocarbon is blended with the above hydrogenated light petrol with the flow rate of 19000 tons/year, the above raffinate oil is extracted out with the flow rate of 38000 tons/year as the fine quality ethylene material.

The distilling range of the obtained blended gasoline is 30-205° C., the sulfur content is 7.52 ppm, the mercaptan content is lower than 1 ppm, olefin content is 17.99% (v), the diolefin content is 0.01% (v), the aromatic hydrocarbon content is 29.1% (v), the octane number (RON) is 95.2, the density is 720.1 kg/m$^3$, the extraction volume is 62000 tons/year.

The distilling range of the obtained fine quality ethylene material is 90-205° C., the sulfur content is 2.0 ppm, the mercaptan content is lower than 1 ppm, olefin content is 6% (v), the diolefin content is lower than 0.01% (v), the aromatic hydrocarbon content is 3.0% (v), the octane number (RON) is 81.5, the density is 740.0 kg/m$^3$, the extraction volume is 38000 tons/year.

Embodiment 4

Figure 3:
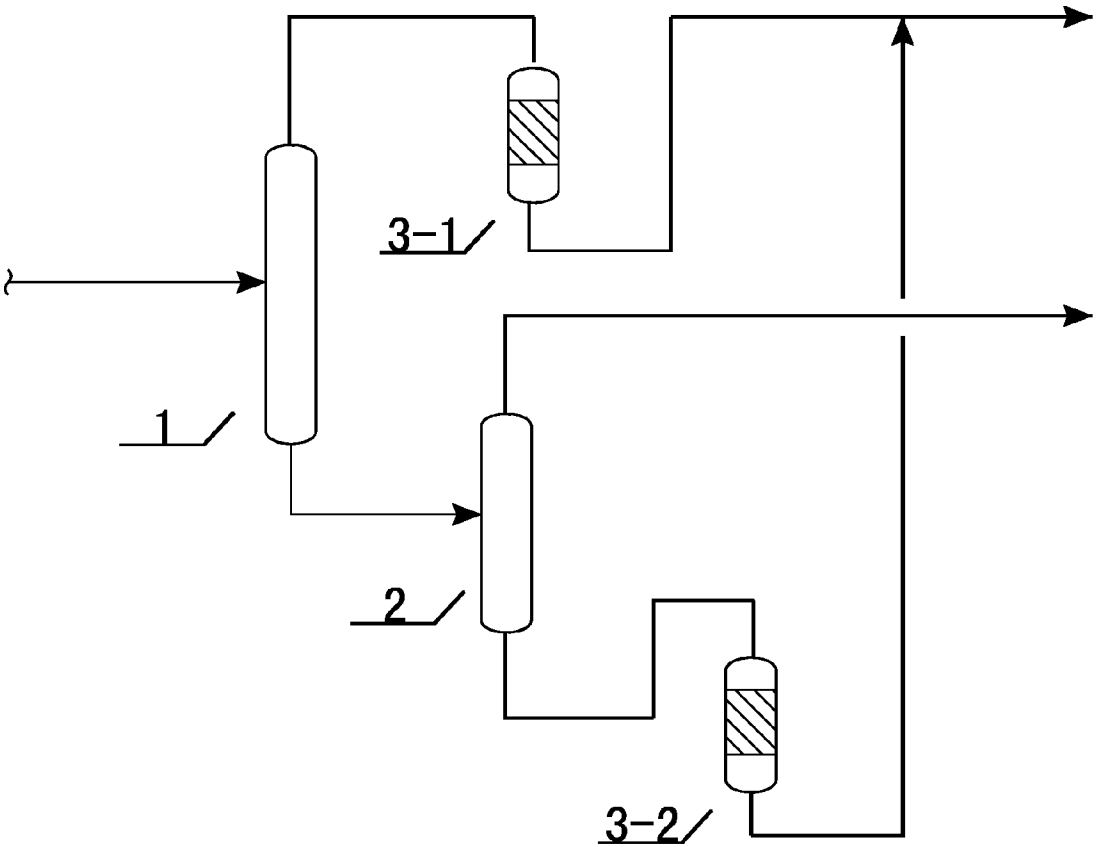
FIG. 3 is the schematic flow sheet of embodiment 4 and 5.

As shown in FIG. 3, it is the schematic flow sheet of this embodiment.

The gasoline is fractionated at fractionator 1 with the flow rate of 100,000 ton/year to the stabilized gasoline (catalytic gasoline) with low sulfur content whose distilling range is 30-205° C., the sulfur content is 100 ppm, the mercaptan content is 5 ppm, the olefin content is 30% (v), the diolefin content is 0.1% (v), the aromatic hydrocarbon content is 15% (v), the octane number (RON) is 89, density is 728 kg/m$^3$, the fractionator overhead temperature of fractionator 1 is 86° C., the fractionator bottom temperature is 192° C., fractionator overhead pressure is 0.2 MPa (absolute pressure), fractionator bottom pressure is 0.25 MPa (absolute pressure), light petrol and heavy petrol can be separately obtained. The above light petrol (distilling range 30-80° C.) is vaporized through the upper of fractionator 1, then it enters the light petrol hydrogenation apparatus 3-1 to carry out hydrogenation treatment, the total vaporization volume after the hydrogenation is 40,000 tons/year. The catalyst of the above light petrol hydrogenation apparatus 3-1 is selective hydrogenation catalyst GHT-20, the volume airspeed ratio of the above light petrol hydrogenation unit 3-1 is 2, hydrogen/oil volume ratio is 150, the operation temperature is 230° C., the operation pressure is 1.0 MPa (absolute pressure). Then the above heavy petrol (distilling range 80~205° C.) passes through the pipeline into the heavy petrol extractor 2 with the flow rate of 60000 tons/years to carry out the extraction separation and the aromatic hydrocarbon & raffinate oil can be separated. The solvent used in extractor 2 is N-formyl-morpholine, the extraction temperature is 115° C., the solvent ratio (solvent/feed material) is 3.5 (mass), the rinsing ratio of the raffinate oil is 0.2 (mass), the solvent recovered temperature is 151° C., the recovery pressure of the solvent is 0.112 MPa (absolute pressure). The above aromatic hydrocarbon enters the aromatic hydrocarbon hydrogenation unit 3-2 with the flow rate of 15000 tons/year to carry out the aromatic hydrocarbon hydrogenation. The catalyst of the above aromatic hydrocarbon hydrogenation unit 3-2 is full hydrogenation catalyst GHT-22. The volume airspeed ratio of the above light petrol hydrogenation unit 3-2 is 2, hydrogen/oil volume ratio is 250, the operation temperature is 295° C., the operation pressure is 2.0 MPa (absolute pressure). Then it will be blended with the above hydrogenated light petrol, the above raffinate oil will be extracted out as the chemical light petrol with the flow rate of 15000 tons/year.

The distilling range of the obtained blended gasoline is 30-205° C., the sulfur content is 4.2 ppm, the mercaptan content is lower than 1 ppm, olefin content is 17.8% (v), the diolefin content is lower than 0.01% (v), the aromatic hydrocarbon content is 25.6% (v), the octane number (RON) is 94.1, the density is 703.8 kg/m$^3$, the extraction volume is 55000 tons/year.

The distilling range of the obtained chemical light petrol is 80-205° C., the sulfur content is 10.0 ppm, the mercaptan content is 1.0 ppm, olefin content is 35.5% (v), the diolefin content is 0.01% (v), the aromatic hydrocarbon content is 3.0% (v), the octane number (RON) is 81.0, the density is 760.0 kg/m$^3$, the extraction volume is 45000 tons/year.

The physical and chemical characteristics of the selective hydrogenation catalyst GHT-20 are as shown in the following table:

| Name of the index | Unit | GHT-20 |
|---|---|---|
| Appearance | | Grey three-leaf type |
| Specification | mm | Φ1.7 |
| Intensity | N/cm | 170 |
| Bulk density | g/ml | 0.70 |
| Specific surface | m$^2$/g | 180 |
| Pore volume | ml/g | 0.55 |
| $WO_3$ | m % | 6.6 |
| NiO | m % | 2.1 |
| $C_0O$ | m % | 0.16 |

Embodiment 5

As shown in FIG. 3, it is the schematic flow sheet of this embodiment.

The gasoline is fractionated at fractionator 1 with the flow rate of 100,000 ton/year in the to the stabilized gasoline (catalytic gasoline) with high sulfur content whose distilling range is 30-205° C., the sulfur content is 2000 ppm, the mercaptan content is 50 ppm, the olefin content is 40% (v), the diolefin content is 1.0% (v), the aromatic hydrocarbon content is 19% (v), the octane number (RON) is 91, density is 728 kg/m$^3$, the fractionator overhead temperature of fractionator 1 is 86° C., the fractionator bottom temperature is 192° C., fractionator overhead pressure is 0.2 MPa (absolute pressure), fractionator bottom pressure is 0.25 MPa (absolute pressure), light petrol and heavy petrol can be separately obtained. The above light petrol (distilling range 30-90° C.) is vaporized through the upper of fractionator 1, then it enters the light petrol hydrogenation apparatus 3-1 to carry out hydrogenation treatment, the total vaporization volume after the hydrogenation is 43,000 tons/year. The catalyst of the above light petrol hydrogenation apparatus 3-1 is selective hydrogenation catalyst GHT-20, the volume airspeed ratio of the above light petrol hydrogenation unit 3-1 is 4, hydrogen/oil volume ratio is 300, the operation temperature is 250° C., the operation pressure is 1.0 MPa (absolute pressure). Then the above heavy petrol (distilling range 90~205° C.) passes through the pipeline into the heavy petrol extractor 2 with the flow rate of 57000 tons/years to carry out the extraction separation and the aromatic hydrocarbon & raffinate oil can be separated. The solvent used in extractor 2 is N-formyl-morpholine, the extraction temperature is 115° C., the solvent ratio (solvent/feed material) is 3.5 (mass), the rinsing ratio of the raffinate oil is 0.2 (mass), the solvent recovered temperature is 151° C., the recovery pressure of the solvent is 0.112 MPa (absolute pressure). The above aromatic hydrocarbon enters the aromatic hydrocarbon hydrogenation unit 3-2 with the flow rate of 15000 tons/year to carry out the aromatic hydrocarbon hydrogenation. The catalyst of the above aromatic hydrocarbon hydrogenation unit 3-2 is full hydrogenation catalyst GHT-22. The volume airspeed ratio of the above aromatic hydrocarbon hydrogenation unit 3-2 is 3, hydrogen/oil volume ratio is 300, the operation temperature is 325° C., the operation pressure is 2.5 MPa (absolute pressure). Then it will be blended with the above-hydrogenated light petrol, the above raffinate oil will be extracted out as the chemical light petrol with the flow rate of 15000 tons/year.

The distilling range of the obtained blended gasoline is 30-205° C., the sulfur content is 10.0 ppm, the mercaptan content is lower than 1 ppm, olefin content is 17.84% (v), the diolefin content is lower than 0.01% (v), the aromatic hydrocarbon content is 28.2% (v), the octane number (RON) is 94.05, the density is 721.4 kg/m$^3$, the extraction volume is 64000 tons/year. The distilling range of the obtained chemical light petrol is 90-205° C., the sulfur content is 10.0 ppm, the mercaptan content is 1.0 ppm, olefin content is 58.3% (v), the diolefin content is 0.01% (v), the aromatic hydrocarbon content is 3.0% (v), the octane number (RON) is 82.0, the density is 740.0 kg/m$^3$, the extraction volume is 36000 tons/year.

INDUSTRIAL APPLICABILITY

The advantage of this invention is as the following:

Compared with the pre-hydrogenation (hydrogenation before the stabilized gasoline enters the distilling unit, it must use great volume of catalyst, in addition, it can only reduce the volume of diolefin and mercaptan), the advantage of the catalytic hydrocarbon recombination system and method is as follows: first, because it is specially used for light petrol, and/or heavy petrol, and/or aromatic hydrocarbon to carry out the hydrogenation treatment, the volume of used catalyst is greatly reduced. Secondly, regarding light petrol, and/or heavy petrol, and/or aromatic hydrocarbon, the volume of used catalyst is greatly reduced. In addition, the content of olefin and diolefin can be reduced, we can not only reduce the content of the mercaptan, but can also reduce the general sulfur content. Finally, as for the selective hydrogenation, specific catalysts and parameters are used, mainly through removal of mercaptan, we can solve the olefin and diolefin problem, the effect is remarkable.

I claim:

1. A system for preparation of a high quality gasoline through recombination of catalytic hydrocarbon, comprising a fractionator, a light gasoline hydrogenation reactor and an extractor, wherein a feeding material is fed into the fractionator and separated into light gasoline and heavy gasoline in the fractionator, an upper part of the fractionator is connected with the light gasoline hydrogenation reactor through a light gasoline pipeline, and the light gasoline from the fractionator is fed into the light gasoline hydrogenation reactor through the light gasoline pipeline; a lower part of the fractionator is connected with the extractor through a heavy gasoline pipeline, and the heavy gasoline is fed into the extractor through the heavy gasoline pipeline; the heavy gasoline is extracted and separated into aromatic hydrocarbon and raffinate in the extractor; and the aromatic hydrocarbon is discharged from a lower part of the extractor which is operatively connected to the light gasoline hydrogenation reactor, and is blended with hydrogenated light gasoline from the light gasoline hydrogenation reactor to form the high quality gasoline.

2. A system according to claim 1, further comprising an aromatic hydrocarbon hydrogenation reactor connected to the lower part of the extractor, wherein the aromatic hydrocarbon discharged from the lower part of the extractor is first fed into the aromatic hydrocarbon hydrogenation reactor to be hydrogenated, and the hydrogenated aromatic hydrocarbon from the aromatic hydrocarbon hydrogenation reactor is then blended with the hydrogenated light gasoline from the light gasoline hydrogenation reactor to form the high quality gasoline.

3. A system according to claim 1, wherein the raffinate is discharged from an upper part of the extractor.

4. A system for preparation of a high quality gasoline through recombination of catalytic hydrocarbon, comprising a fractionator, a light gasoline hydrogenation reactor, a heavy gasoline hydrogenation reactor and an extractor, wherein a feeding material is fed into the extractor and separated into light gasoline and heavy gasoline in the fractionators, an upper part of the fractionator is connected with the light gasoline hydrogenation reactor through a light gasoline pipeline, and the light gasoline from the fractionator is fed into the light gasoline hydrogenation reactor through the light gasoline pipeline; a lower part of the fractionator is connected with the heavy gasoline hydrogenation reactor through a heavy gasoline pipeline, and the heavy gasoline from the fractionator is fed into the heavy gasoline hydrogenation reactor through the heavy gasoline pipeline to be hydrogenated; the hydrogenated heavy gasoline is fed into the extractor, extracted and separated into hydrogenated aromatic hydrocarbon and raffinate in the extractor; the extractor is operatively connected to the light gasoline hydrogenation reactor, the hydrogenated aromatic hydrocarbon is discharged from a lower part of the extractor and blended with hydrogenated light gasoline from the light gasoline hydrogenation reactor to form the high quality gasoline.

5. A system according to claim 4, wherein the raffinate is discharged from an upper part of the extractor.

* * * * *